US005649585A

United States Patent [19]

Nolte et al.

[11] Patent Number: 5,649,585

[45] Date of Patent: Jul. 22, 1997

[54] PROCESS FOR PRODUCING FIBER COMPOSITE INVESTMENT CASTINGS

[76] Inventors: Markus Nolte, Zum Kampe 25, 33104 Paderborn, Germany; Juergen Schaedlich-Stubenrauch, Vaalserhaagweg 4A, 6291 CN Vaals, Netherlands; Eric Neussl, Koelner Weg 13, 50259 Stommeln, Germany

[21] Appl. No.: 397,264

[22] PCT Filed: Sep. 10, 1993

[86] PCT No.: PCT/DE93/00836

§ 371 Date: Nov. 29, 1995

§ 102(e) Date: Nov. 29, 1995

[87] PCT Pub. No.: WO94/06582

PCT Pub. Date: Mar. 31, 1994

[30] Foreign Application Priority Data

Sep. 16, 1992 [DE] Germany ..... 42 30 970.0

[51] Int. Cl.[6] ..... B22C 9/04; B22D 19/14

[52] U.S. Cl. ..... 164/10; 164/9; 164/97

[58] Field of Search ..... 164/97, 9, 10

[56] References Cited

U.S. PATENT DOCUMENTS 4,476,916 10/1984 Nusbaum .

5,394,930 3/1995 Kennerknecht ..... 164/97 X

FOREIGN PATENT DOCUMENTS 1508655 10/1969 Germany .

57-68261 4/1982 Japan ..... 164/97

58-29564 2/1983 Japan ..... 164/97

WO89/09669 10/1989 WIPO ..... 164/97

OTHER PUBLICATIONS

Abstract of Japanese Patent Publication 4–089155 Published Mar. 23, 1992.

Abstract of Japanese Patent Publication 4–143063 Published May 18, 1992.

*Primary Examiner*—J. Reed Batten, Jr.

*Attorney, Agent, or Firm*—Birch, Stewart, Kolasch & Birch, LLP

[57] ABSTRACT

At least one preliminary pattern body, which is then used as part of a pattern or the pattern itself, is produced with fibers and a pattern material. A ceramic mold is formed around the pattern with a portion of the fibers having ends embedded into the mold. The pattern material is removed and finally, metal in liquid, liquid-solid or powdery form is introduced into the mold, wherein the metal is at least partially liquefied in the mold when it is introduced in powdery form. This process allows investment castings having an increased resistance to be produced with relatively simple casting equipment.

12 Claims, 4 Drawing Sheets

PROCESS FOR PRODUCING FIBER COMPOSITE INVESTMENT CASTINGS

FIELD OF THE INVENTION

The invention relates to a process for producing fiber composite investment castings.

DISCUSSION OF CONVENTIONAL ART

A process for producing investment castings is known, wherein a pattern is formed by using a pattern material, a ceramic mold is formed around the pattern, the pattern material is subsequently melted off, burned out and/or gasified and finally, liquid metal is introduced into the mold.

According to such a process, investment castings of very complex geometry can be produced. Owing to such a geometry and due to the fact that the ceramic mold formed according to this process does only resist relatively low pressures when introducing the liquid metal into the mold, the use of reinforcing fibers, i.e. the production of fiber composite investment castings, is not yet in practice.

SUMMARY OF THE INVENTION

It is the object of the present invention to provide a process which permits the production of fiber composite investment castings with tolerable production expenditure.

In case of a process of the above-mentioned kind, this object is solved, according to the invention, by producing at least one preliminary pattern body of fibers and a pattern material, which is then used as part of a pattern or the pattern itself, then forming a ceramic mold around the pattern, and subsequently introducing metal in liquid, liquid-solid or powdery form into the mold, wherein, in case of an introduction in powdery form, the metal is at least partially liquefied in the mold. Such a preliminary body offers a far-reaching freedom of design. This means that the preliminary body can readily be adapted to the casting to be produced. Thus, the fiber orientation and the material reinforcement in the casting intended through them can be achieved purposefully at the desired sites.

DETAILED DESCRIPTION OF THE INVENTION

According to the process of the invention, the pattern material is removed by melting off and/or burning out and/or gasifying and/or releasing.

According to the process of the invention, fibers having special mechanical and/or physical and/or chemical properties are used. This means that the fibers can be selected with respect to the respectively desired properties.

According to the process of the invention, mineral fibers are used as fibers. These may be $Al_2O_3$ or SiC fibers, which, e.g., are 10 μm thick. Handling such fibers may present a danger to health if these fibers are bare. According to the present process, however, it is possible to mechanically make up such fibers into preliminary bodies. When handling these preliminary bodies, these fibers, however, are then enclosed by the pattern material and do therefore no longer present a danger to health.

According to the process of the invention, the fibers are used in the form of a bundle of monofilaments or multifilaments, or as wovens, nonwovens or fiberwoven fabrics, or as fiber parisons. The selection among the possibilities given herein can be made according to the respective shapes and requirements of the casting to be produced.

According the process of the invention, wax is used as pattern material. This pattern material is the one which is used most often and which can, as a rule, be treated most easily. Only a relatively low energy expenditure is required to remove it from the mold.

Further, the process according to the invention can be performed such that synthetic resin is used as pattern material. Due to the selected fibers and also with respect to the respective three-dimensional shape, this pattern material can be particularly suited for special applications.

According to the process of the invention, the preliminary body is released from the pattern material at its ends or edges, and the thus bare fiber sections, when forming the ceramic mold, are fixedly embedded therein. Thus, the preliminary body can be placed particularly exactly in the mold and thus in the casting to be produced.

Further, the process according to the invention can be performed such that the preliminary body is adapted to the requirements as to geometry and load of the investment casting to be produced by corresponding shaping.

According to the process of the invention, the pattern is solely made of at least one preliminary body. This means that the preliminary body can directly assume the shape of the casting to be produced and need not be developed further by depositing pattern material. Such a procedure offers advantages with simple shapes in particular.

According to the process of the invention, one or several preliminary bodies are surrounded by pattern material for the purpose of forming a pattern. Also in this manner, a sufficiently precise placing of the preliminary body or preliminary bodies in the pattern can be achieved.

According to the process of the invention, the pressure in the mold environment is lowered below the pressure in the mold interior. In addition thereto or alternatively, the process according to the invention can be performed such that the pressure in the mold interior can be raised above the pressure in the mold environment. Due to these pressure differences, it is assured that the intermediate spaces between the fibers are completely filled with liquid metal by pressing and/or sucking. The pressing is performed by the influence of pressure on the liquid metal located in the mold, the sucking by inserting the gas-permeable mold into a container in which a partial vacuum prevails.

The process according to the invention does not require a permanent bond in the form of binder bridges or the like between the fibers, as has so far been known in the use of preforms. There, such binder bridges of the preforms impede the metal infiltration. In the process according to the invention, it is possible to do without such binder bridges because the fibers in the preliminary body are held by the pattern material until the mold cavity is closed and the pattern material is removed then.

BRIEF DESCRIPTION OF THE DRAWINGS

In the following part of the specification, several embodiments of the method according to the invention are described with reference to the drawings. The figures show.

SPECIFIC EMBODIMENTS OF THE INVENTION

Figure 1:
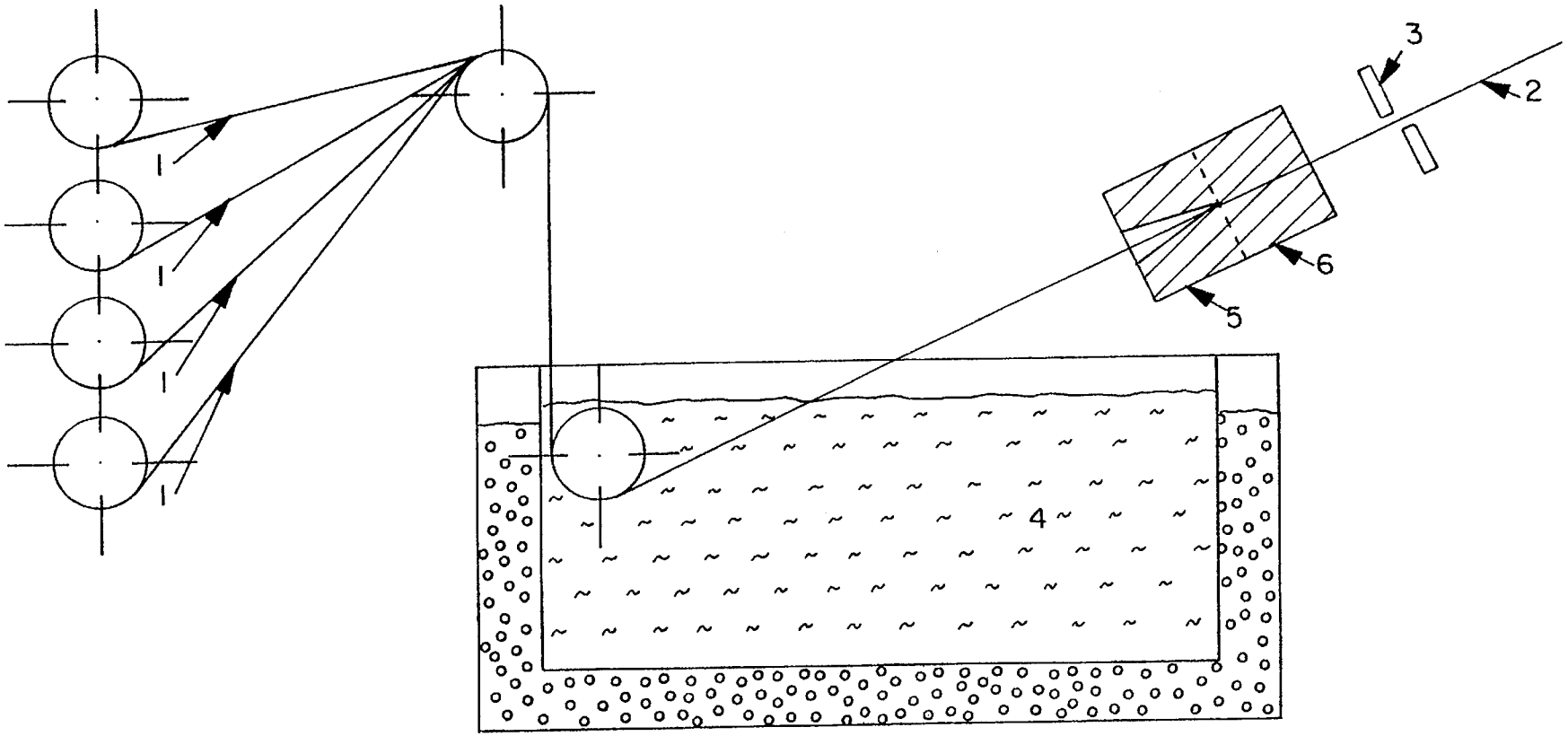
FIG. 1 a device for producing rod-shaped or block-shaped preliminary bodies, FIG. 2 examples of cross sections of such molding bodies, FIG. 3 an embodiment of a half of an injection molding tool with the preliminary body being inserted in plan view and side view, FIG. 4 a further embodiment of a half of an injection molding tool with the preliminary body being inserted, FIG. 5 a finished pattern with fiber sections being bare at their ends, and FIG. 6 the pattern according to FIG. 5, embedded in a shell mold.

In FIG. 1, it is shown in schematic form how strand-shaped preliminary bodies 2 cut to the desired length are formed from "endless" fibers 1. For this purpose, several fibers 1 are passed through a heated wax bath 4 by means of rolls and impregnated with wax there so that all individual fibers 1 are wetted with wax. The thus impregnated wax fiber strand is shaped into the desired cross section in a heated pattern die 5 and solidified in a downstream cooling means 6. The thus obtained, initially "endless" wax fiber preliminary body is cut into the desired lengths by means of a separating device 3.

Figure 2:
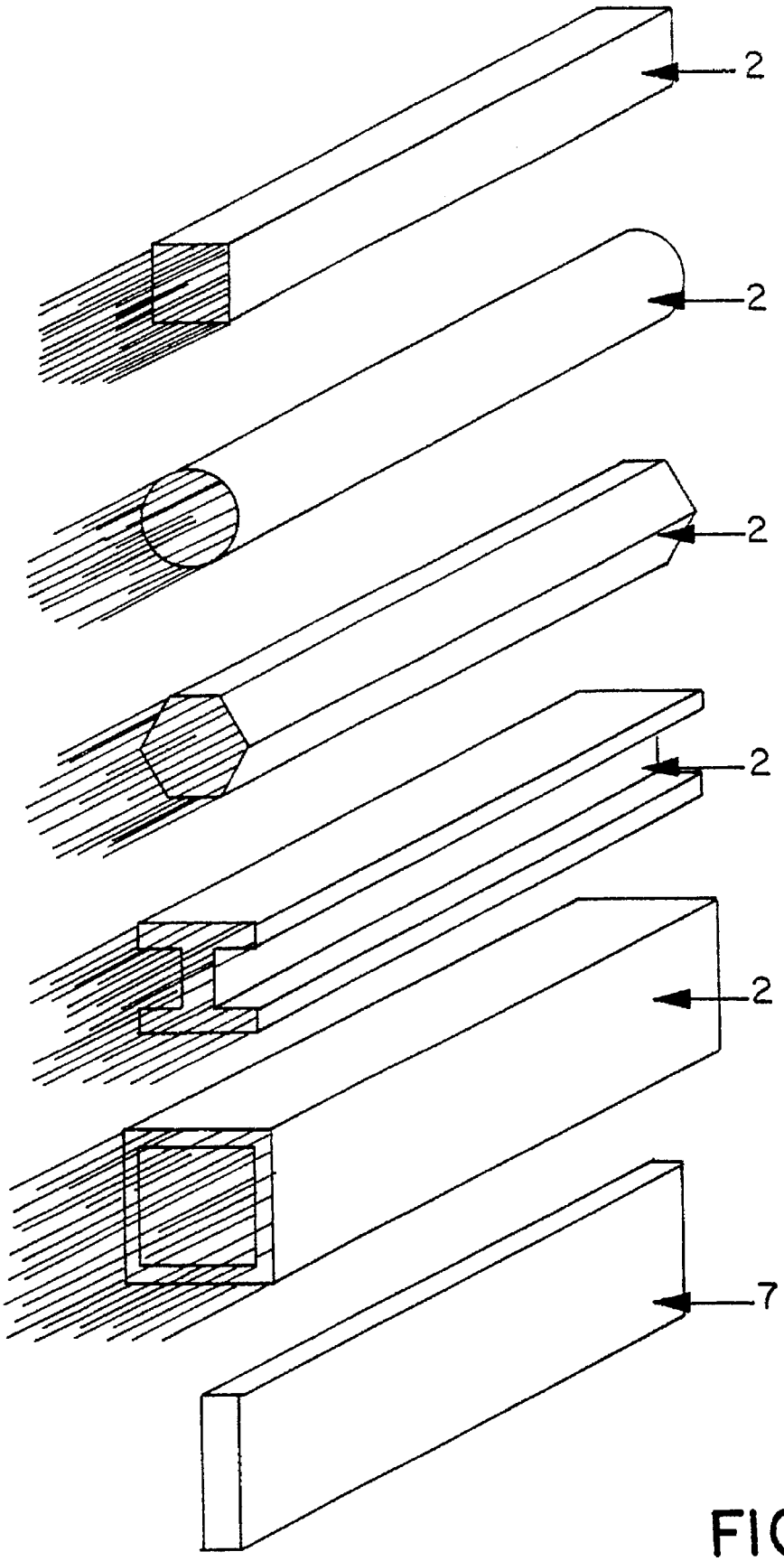

FIG. 2 shows some examples of various cross sections of such preliminary bodies 2. In this manner, profiles with a high package density of the fibers as well as profiles with a high resistance moment and combinations thereof can be realized. Further, a two-dimensionally configured preliminary body 7 is shown in FIG. 2, which, e.g., can be made in the form of a woven.

Figure 3:
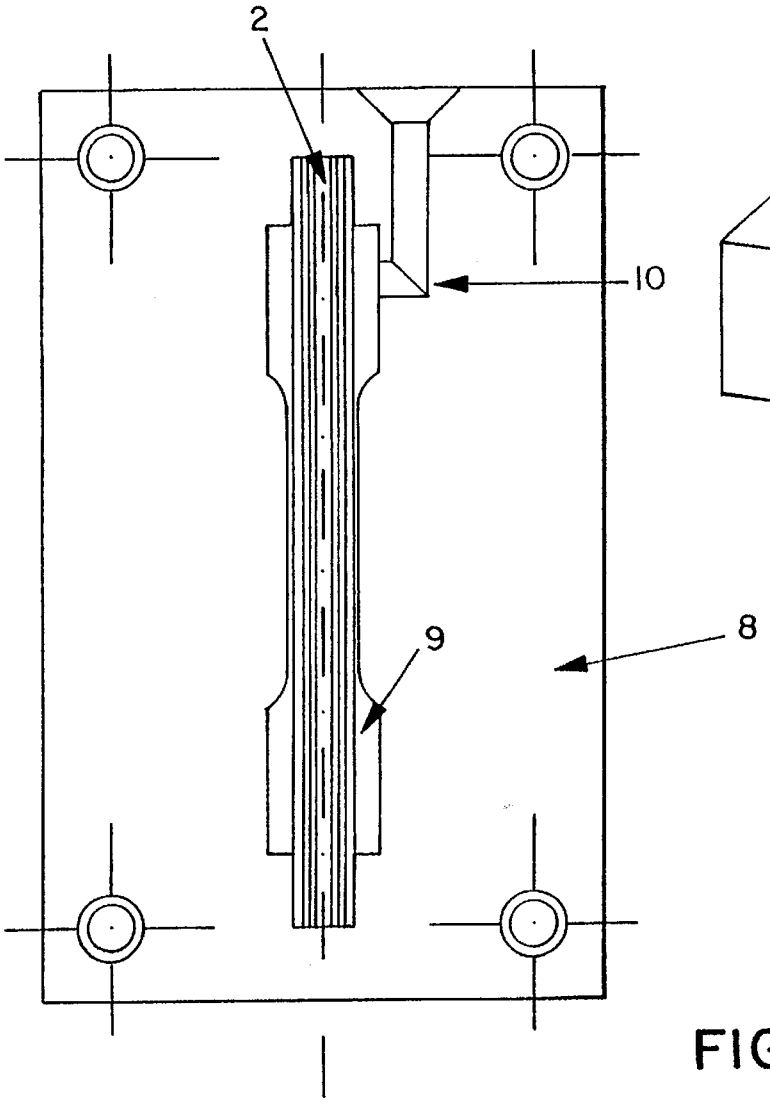

FIG. 3 shows an embodiment of a half 8 of an injection molding tool consisting of two halves. In this half 8, a preliminary body 2 is inserted around which a pattern 9 is formed. While doing so, the preliminary body 2 projects beyond the pattern 9 with its two ends. After assembling the injection molding tool, pattern wax is injected through an injection channel 10 around the preliminary body 2 and thus, the pattern contour is filled up.

Figure 4:
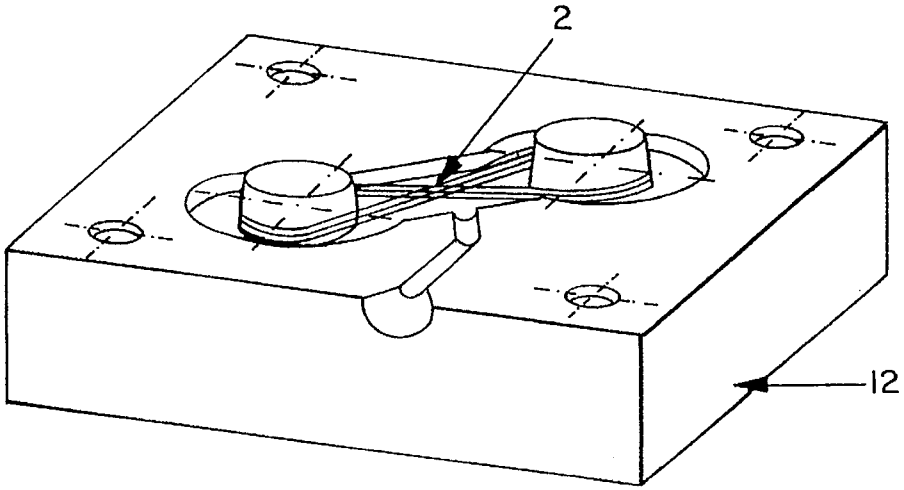

FIG. 4 shows an embodiment of a half 12 of an injection molding tool, wherein the inserted preliminary bodies 2 do not emerge from the pattern body. To insert the preliminary bodies 2 in reproducible pattern positions in the injection molding tool, winding devices can be used. After closing the injection molding tool, pattern wax is injected here as well, which encloses the preliminary body or the preliminary bodies so that a pattern is formed.

Figure 5:
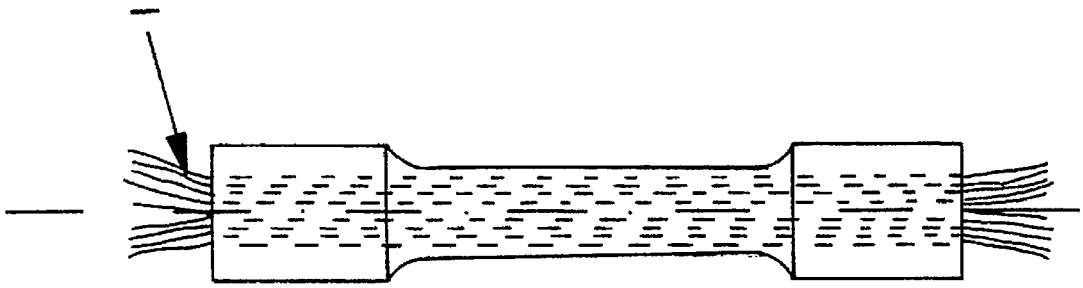

FIG. 5 shows a finished pattern with bare fiber ends emerging therefrom. These ends serve for fixing the fibers 1 in an investment casting mold shell. The bare fiber sections are surrounded by ceramic slurry and stuccoing material used in the production of investment casting mold shells and are thus firmly anchored in the mold shell which is being formed. Then, the pattern material is melted off, burned out, gasified or released. When inserting the metal, the fibers thus anchored in the mold shell cannot be moved out of their predetermined desired position.

Figure 6:
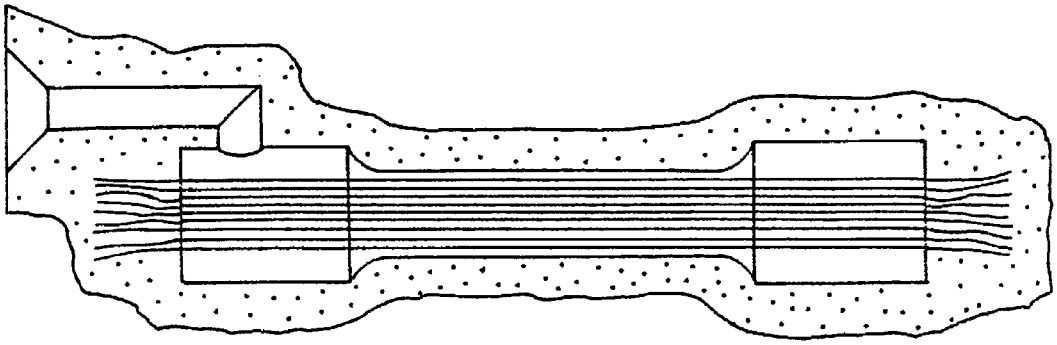

Finally, FIG. 6 shows the pattern according to FIG. 5 in an investment casting mold shell formed of ceramic slurry and stuccoing material.

We claim:

1. Process for producing fiber composite investment castings, which comprises:

providing at least one preliminary pattern body which constitutes fibers of high strength, high rigidity or both high strength and high rigidity embedded in a pattern material;

forming a gas-permeable ceramic mold on the preliminary pattern body surface such that at least a portion of the fibers have ends embedded into the ceramic mold;

removing the pattern material from the fibers of the preliminary pattern body such that the fibers remain in the ceramic mold by melting off, burning out or gasifying the pattern material; and introducing liquid metal into the ceramic mold such that the liquid metal infiltrates the fibers in order to form the fiber composite investment casting.

2. The process according to claim 1, wherein the fibers are mineral fibers.

3. The process according to claim 1 or 2, wherein the fibers are in the form of a bundle of monofilaments, a bundle of multifilaments wovens, nonwovens, fiberwoven fabrics or fiber parisons with binder bridges.

4. The process according to claim 1 or 2, wherein the pattern material is wax.

5. The process according to claim 1 or 2, wherein the pattern material is synthetic resin.

6. The process according to claim 1 or 2, wherein the pattern material is removed from the preliminary pattern body at the ends or edges such that bare fiber sections are fixedly embedded into the ceramic mold.

7. The process according to claim 1 or 2, wherein the preliminary pattern body is adapted to the requirements with respect to the geometry and load of the investment castings to be produced by corresponding shaping.

8. The process according to claim 1 or 2, wherein a pattern is solely made of at least one preliminary pattern body.

9. The process according to claim 1 or 2, wherein one or several preliminary pattern bodies are surrounded by pattern material for the purpose of forming a pattern.

10. The process according to claim 1 or 2, wherein the pressure in the mold environment is lowered below the pressure in the mold interior in order to increase infiltration by the liquid metal into the fibers.

11. The process according to claim 10, wherein the gas-permeable ceramic mold is inserted into a container in which a partial vacuum is generated.

12. The process according to claim 1 or 2, wherein the pressure in the mold interior is raised above the pressure in the mold environment in order to increase infiltration by the liquid metal into the fibers.

* * * * *